US008166696B2

(12) United States Patent
Hamilton

(10) Patent No.: US 8,166,696 B2
(45) Date of Patent: May 1, 2012

(54) RIFLE SCOPE WITH ADJUSTMENT STOP

(75) Inventor: Samuel J. Hamilton, Mount Horeb, WI (US)

(73) Assignee: Sheltered Wings, Inc., Middleton, WI (US)

( * ) Notice: Subject to any disclaimer, the term of this patent is extended or adjusted under 35 U.S.C. 154(b) by 418 days.

(21) Appl. No.: 12/584,856

(22) Filed: Sep. 14, 2009

(65) Prior Publication Data

US 2011/0061285 A1 Mar. 17, 2011

(51) Int. Cl.
*F41G 1/38* (2006.01)

(52) U.S. Cl. ..... 42/122; 359/429

(58) Field of Classification Search ..... 42/119, 42/120, 122; 359/399, 429
See application file for complete search history.

(56) References Cited

U.S. PATENT DOCUMENTS 6,279,259 B1 * 8/2001 Otteman ..... 42/122
6,643,970 B2 11/2003 Huber
6,772,550 B1 * 8/2004 Leatherwood ..... 42/119
2008/0066364 A1 * 3/2008 Klepp et al. ..... 42/122
2010/0175298 A1 * 7/2010 Thomas et al. ..... 42/122
2011/0102918 A1 * 5/2011 Windauer ..... 359/821

* cited by examiner

*Primary Examiner* — Gabriel Klein
(74) *Attorney, Agent, or Firm* — Bennet K. Langlotz; Langlotz Patent & Trademark Works, Inc.

(57) ABSTRACT

Rifle scopes with adjustment stops include a scope body, a movable optical element defining an optical axis enclosed by the scope body, and a turret having a screw operably connected to the optical element for adjusting the optical axis in response to rotation of the screw. The turret has a stop element selectably engaged to the screw. The body defines a stop surface positioned for engagement by the turret stop element to limit rotation of the screw, such that the relative position at which the stop element is secured to the screw defines a zero position of the screw and the movable optical element. The stop element is held against the stop surface by an indexing portion while the relative position at which the stop element is secured to the screw to define the zero position is determined.

13 Claims, 9 Drawing Sheets

RIFLE SCOPE WITH ADJUSTMENT STOP

FIELD OF THE INVENTION

The present invention relates to a rifle scope with adjustment stop that prevents adjustment of a turret beyond a preset amount.

BACKGROUND OF THE INVENTION

A turret is one of two knobs in the outside center part of a riflescope body. Turrets are marked in increments and are used to adjust elevation and windage for points of impact change. Conventional turrets have markings on them that indicate how many clicks of adjustment have been dialed in on the turret, or an angular deviation, or a distance compensation for a given cartridge. A click is one tactile adjustment increment on the windage or elevation turret of a scope.

In order to achieve accurate sighting of objects at greater distances, the downward acceleration on the projectile imparted by gravity is of greater significance. The effect of gravity on a projectile in flight is often referred to as bullet drop because it causes the bullet to drop from the shooter's line of sight. For accuracy at longer distances, the sighting components of a gun must compensate for the effect of bullet drop. An adjustment to the angular position of the rifle scope relative to the rifle barrel is made using the elevation turret to compensate for bullet drop.

A zero point for the scope is determined by adjusting the angular position of the rifle scope relative to the rifle barrel until the impact point of the bullet matches a target at a known distance when viewed through the scope reticle. For targets at greater distances than the distance used for establishing the scope's zero point, the elevation turret is used to adjust the angular position of the scope with respect to the rifle barrel to compensate for the greater amount of bullet drop.

Conventional elevation turrets allow for multiple rotations in order to enable the scope to compensate for longer-range targets. Unfortunately, because conventional turrets lack a zero stop mechanism, the zero point can be easily lost when elevation is dialed. Even when the turret's markings are visible, the user may miss the zero point by one or more rotations if he or she does not carefully count the number of rotations both while dialing away from the zero point and when dialing towards the zero point.

Another difficulty with existing rifle scopes is that certain operating conditions require the user to remember both how many clicks and the direction of rotation needed to return the elevation turret to its zero point from a different setting. When light conditions are poor, such as at twilight, night, or in darkened rooms of buildings, or if it is difficult for the user to hear or feel the clicks, it is very easy for the user to lose track of what adjustment is needed to return to the zero point. Under such conditions, the markings may not be sufficiently visible. This is particularly significant for police and military users of firearms, who in the course of their duties may very likely be confronted with a threat under poor lighting conditions. In addition, hunters may hunt at twilight or in deep shade.

Because of the need for compact riflescope components, markings are necessarily small, making them difficult to read under borderline conditions. While this may be a concern when making fine adjustments, it is of greater concern when a user must make large changes involving several revolutions of a knob, which may lead to an error in the number of revolutions made.

Turrets that prevent downward advancement of the turret screw beyond a preset zero point are known. One such device is shown in U.S. Pat. No. 6,643,970 to Huber, titled "Zero Stop Adjustable Rifle Scope." This "zero stop" rifle scope adjustment mechanism enables the user to position a stop ring and lock ring on the turret screw to prevent downward advancement of the turret screw beyond a position associated with the scope's zero point. The disclosed device makes it easy for the user to return to the zero point after adjusting the scope for a longer-range target and prevents the user from over adjusting beyond the zero point.

The Huber device suffers the disadvantage of requiring the user to perform a complex series of operations in order to configure the zero stop rifle scope adjustment mechanism. The user is required to hold the turret screw in the desired position associated with the zero point while simultaneously rotating the stop ring downward over the turret screw until it makes contact with the index dial. The user then has to continue to hold the turret screw in the desired position associated with the zero point while rotating the lock ring downward onto the adjustment bolt until the lock ring makes contact with the stop ring. Finally, the user has to continue to hold the turret screw in the desired position associated with the zero point while tightening screws to lock the stop ring and lock ring together and to bind them to the turret screw. Performing all of these operations without inadvertently changing the position of the turret screw and introducing error into the zero stop adjustment mechanism is extremely difficult.

Furthermore, the Huber design uses small aluminum tabs to stop rotation, which result in a very small contact surface area. Each tab has an area less than 1 square mm, and the tabs are only about 1.5 mm thick. Their small size and aluminum composition make Huber's tabs prone to creep and/or shearing with repeated use. The Huber design is therefore vulnerable to having an undesirably short service life.

In addition, the Huber design requires the user to expose the internal clicker mechanism and zero stop mechanism to the elements in order to set the zero stop. In sandy, dusty, and dirty environments, exposure could cause Huber's zero stop or clicker mechanism to become contaminated by foreign material. This could result in reduced performance or even render them inoperable over time.

Finally, the Huber design is known to experience movement of its zero stop when the turret is spun into the stop surface hard enough. Any movement of the zero stop causes the user to have to reset it again, making such movement highly undesirable. Rapid, forceful movements of the turret could readily occur under stressful conditions, such as an enemy closing in on a position in combat, resulting in the zero stop being thrown off at the worst possible time.

Therefore, a need exists for a new and improved rifle scope with adjustment stop that prevents adjustment of a turret beyond a preset amount. In this regard, the various embodiments of the present invention substantially fulfill at least some of these needs. In this respect, the rifle scope with adjustment stop according to the present invention substantially departs from the conventional concepts and designs of the prior art, and in doing so provides an apparatus primarily developed for the purpose of preventing adjustment of a turret beyond a preset amount.

SUMMARY OF THE INVENTION

The present invention provides an improved rifle scope with adjustment stop, and overcomes the above-mentioned disadvantages and drawbacks of the prior art. As such, the general purpose of the present invention, which will be described subsequently in greater detail, is to provide an improved rifle scope with adjustment stop that has all the advantages of the prior art mentioned above.

To attain this, the preferred embodiment of the present invention essentially comprises a scope body, a movable optical element defining an optical axis enclosed by the scope body, and a turret having a screw operably connected to the optical element for adjusting the optical axis in response to rotation of the screw. The turret has a stop element selectably engaged to the screw. The body defines a stop surface positioned for engagement by the turret stop element to limit rotation of the screw, such that the relative position at which the stop element is secured to the screw defines a zero position of the screw and the movable optical element. The stop element is held against the stop surface by an indexing portion while the relative position at which the stop element is secured to the screw to define the zero position is determined. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
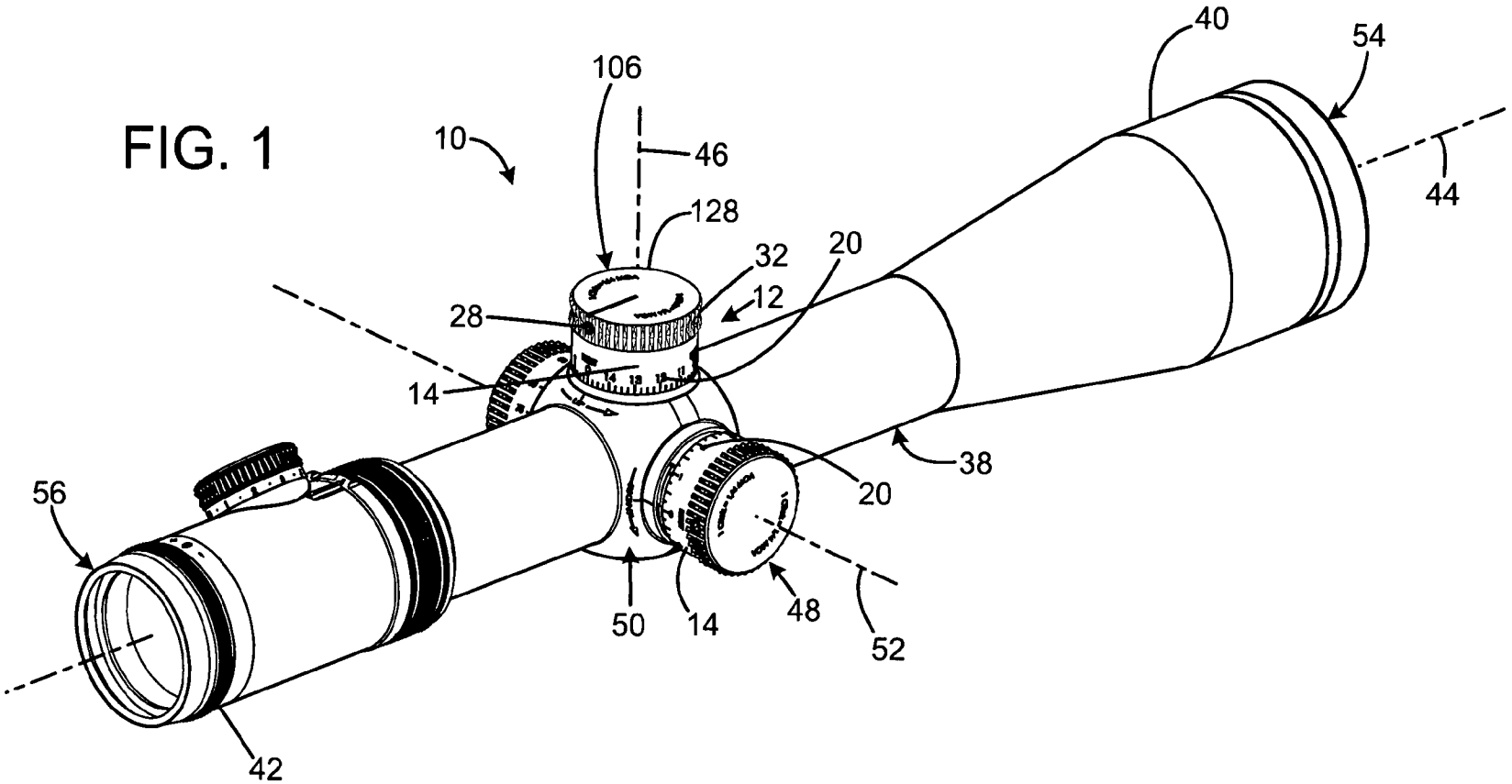
FIG. 1 is a top perspective view of the current embodiment of the rifle scope with adjustment stop constructed in accordance with the principles of the present invention.

A preferred embodiment of the rifle scope with adjustment stop of the present invention is shown and generally designated by the reference numeral 10.

FIG. 1 illustrates the improved rifle scope with adjustment stop 10 of the present invention. More particularly, the rifle scope 10 has a scope body 38 that encloses a movable optical element 126 (shown in FIG. 8), which is an erector tube. The scope body 38 is an elongate tube tapering from a larger opening at its front 40 to a smaller opening at its rear 42. An eyepiece 56 is attached to the rear of the scope body, and an objective lens 54 is attached to the front of the scope body. The center axis of the movable optical element defines the optical axis 44 of the rifle scope.

An elevation turret 12 and a windage turret 48 are two knobs in the outside center part of the scope body 38. They are marked in increments by indicia 20 on their perimeters 14 and are used to adjust the elevation and windage of the movable optical element for points of impact change. These knobs protrude from the turret housing 50. The turrets are arranged so that the elevation turret rotation axis 46 is perpendicular to the windage turret rotation axis 52.

The movable optical element is adjusted by rotating the turrets one or more clicks. A click is one tactile adjustment increment on the windage or elevation turret of the rifle scope, each of which corresponds to an indicium 20. One click may change a scope's point of impact by ¼ inch at 100 yards, but a click may take on other values, such as ½ inch, 0.1 milliradian, etc. In the illustrated embodiment, one click equals ¼ Minute of Angle. Minute of Angle (MOA) is a unit of measurement of a circle, which is 1.0472 inches at 100 yards. Conventionally, it is referred to as being 1 inch at 100 yards, 2 inches at 200 yards, 5 inches at 500 yards, ½ inch at 50 yards, etc.

Figure 2:
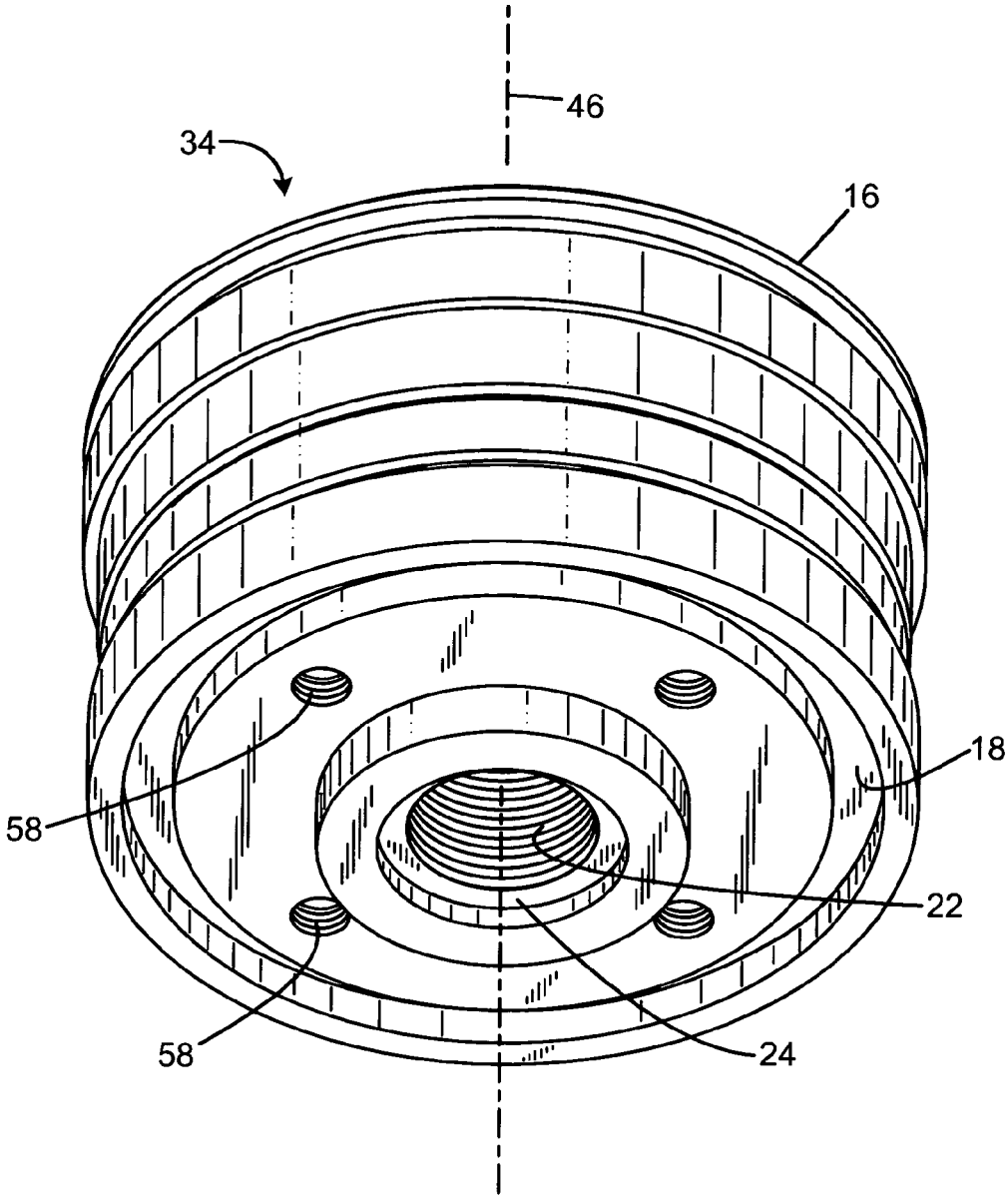
FIG. 2 is a bottom perspective view of the current embodiment of the elevation turret base of the present invention.

FIG. 2 illustrates the improved elevation turret base 34 of the present invention. More particularly, the turret base is a cylindrical body of two-piece construction with a steel top section 16 and a brass bottom section 18. The two sections are secured together by threads 154 and 156 (shown in FIG. 8). The bottom section of the turret base has four turret housing mount holes 58 that are threaded to receive screws 158 to mount the turret base to the turret housing 50. The turret base is mated to the scope body 38 and remains in a fixed position with respect to the scope body when the elevation turret is rotated. This essentially makes the turret base functionally unitary with the scope body 38, and the turret base is not intended to be removed or adjusted by the user.

The center of the bottom of the turret base has a threaded turret screw bore 22 that terminates in a wider C-ring recess 24. The turret screw bore 22 is finely threaded such that it may receive the threads 94 on the bottom 146 of a turret screw 36, as will be discussed with respect to FIG. 6.

Figure 3:
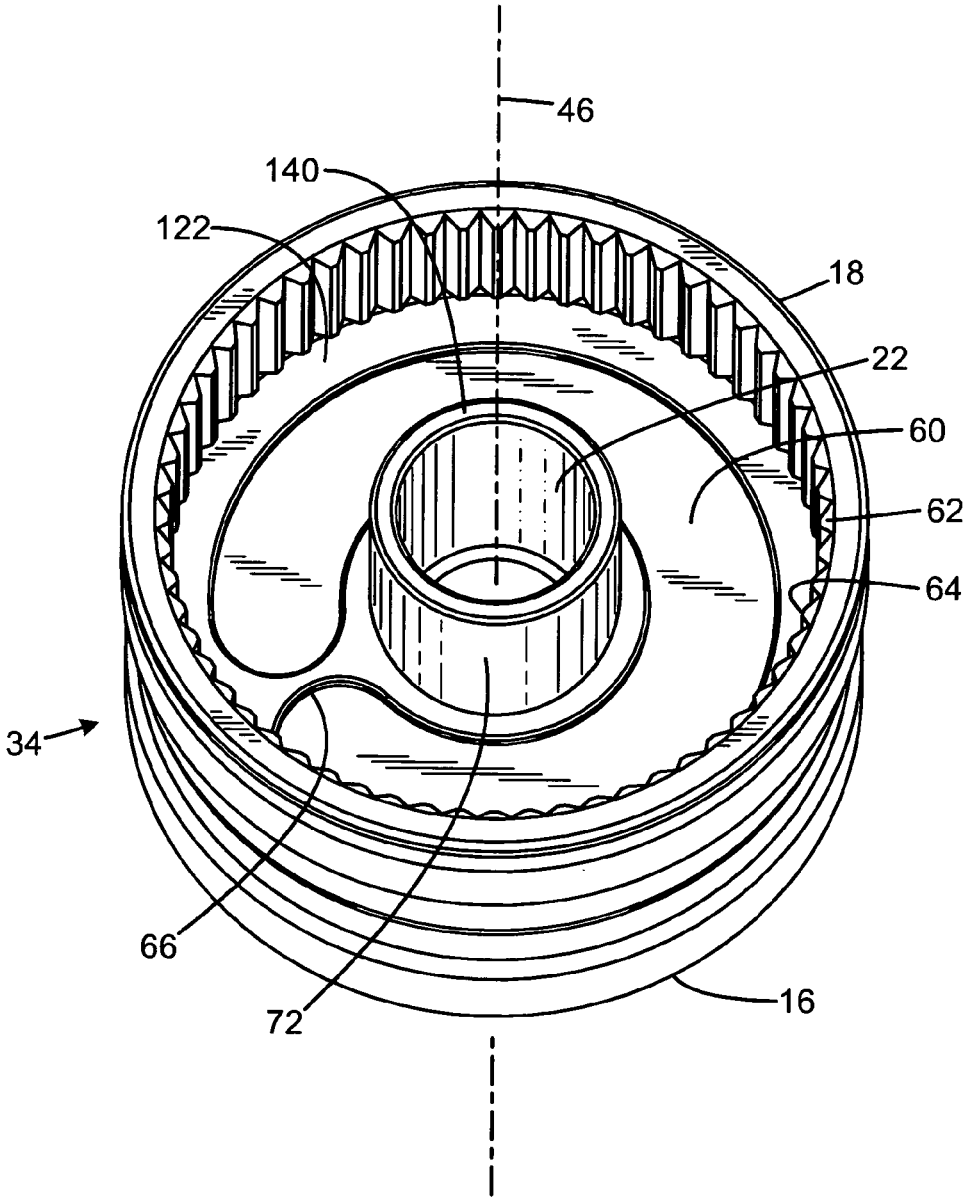
FIG. 3 is a top perspective view of the current embodiment of the elevation turret base of the present invention.

FIG. 3 illustrates the improved elevation turret base 34 of the present invention. More particularly, the top of the turret base has an interior perimeter 62 with a toothed surface 64. A stop collar sleeve 72 projects upwards from the interior surface 122. The stop collar sleeve is adapted such that it may receive the turret screw 36, and the stop collar sleeve is in communication with the turret screw bore 22.

The bottom section 18 of the turret base has an interior surface 122 that defines a recessed track 60. The track is a C-shaped indentation that nearly encompasses the stop collar sleeve. The track terminates in a stop surface 66 when it is traversed in a clockwise direction. Alternatively, the track could be replaced with a C-shaped obstruction that sticks up from the interior surface of the turret base where the track's stop surface is. The track is adapted to receive a stopper 76 that will be described in more detail in the discussion of FIG. 4B. The track and stop surface are essentially fixed to the body of the scope and not adjustable.

Figure 4A:
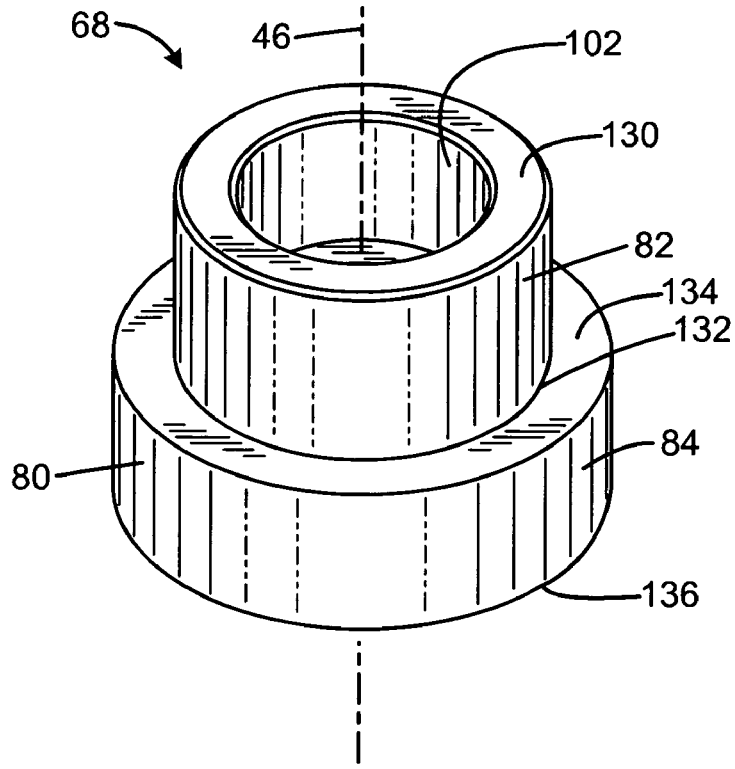
FIG. 4A is a top perspective view of the current embodiment of the stop collar assembly of the present invention.
Figure 4B:
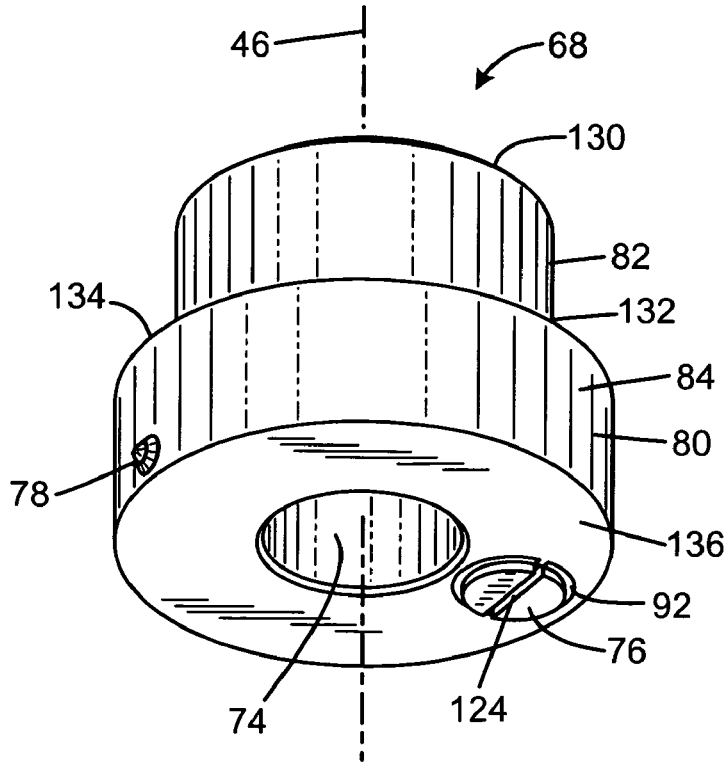
FIG. 4B is a bottom perspective view of the current embodiment of the stop collar assembly of the present invention.

FIGS. 4A and 4B illustrate improved stop collar assembly 68 of the present invention. More particularly, the stop collar assembly is of one-piece brass construction with an upper portion 82 and a lower portion 84. Both the upper portion and the lower portion are cylindrical bodies with tops 130 and 134, bottoms 132 and 136, and an outer perimeter 80. The stop collar assembly is made of brass so that it has anti-galling properties with the surfaces that it turns against.

The upper portion has an upper bore portion 102 that is adapted such that it loosely receives the head 96 of the turret screw 36. The upper opening communicates with a smooth stop collar sleeve bore 74 in the lower portion 84. The stop collar sleeve bore is adapted such that it closely receives the stop collar sleeve 72 of the elevation turret base 34, as will be discussed below.

A clicker 78 protrudes from the outer perimeter of the lower portion. The clicker is a steel ball bearing that is spring-biased to engage with the toothed surface 64 of the elevation turret base.

A stopper 76 is a cylindrical body resembling a fat set screw that is threadedly inserted into a threaded stopper bore 92 in the outer perimeter of the bottom of the lower portion. In the current embodiment, the stopper is made of steel so that it has sufficient wear resistance to endure frequent hard impacts with the stop surface 66. Although the stopper and stop collar assembly could be manufactured as a unitary part, the difficulty of doing so and the benefits of having a brass stop collar assembly and a steel stopper make the present approach preferable.

The stopper has a slot 124 in its top end face so it can be installed in the stopper bore by a screwdriver or coin. The amount the stopper protrudes from the bottom of the lower portion is adjustable by rotating the stopper. The top end face of the stopper is a smooth cylindrical surface so that the stopper's threads are not exposed to contact the track's stop surface. As will be discussed in greater detail below, the protrusion amount is set to engage the stop surface to arrest the stopper's clockwise motion in less than one rotation of the turret screw 36 after the stopper first enters the track while otherwise permitting free rotation without the stopper hitting the bottom of the track. When the stopper cannot continue to rotate clockwise, further downward adjustment of the turret screw is prevented.

Figure 5:
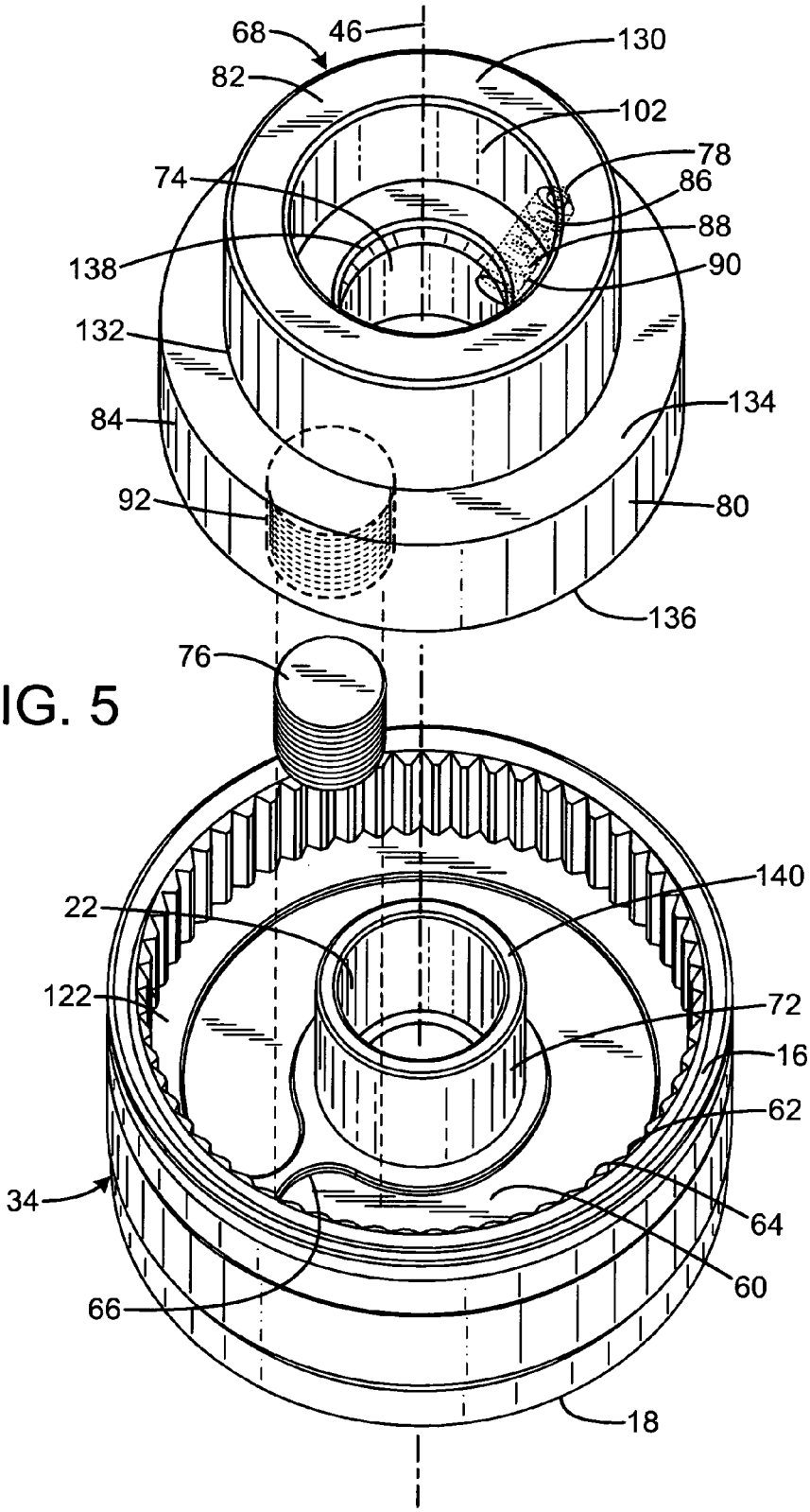
FIG. 5 is a top perspective exploded view of the stop collar assembly and the elevation turret base of the present invention.

FIG. 5 illustrates the improved stop collar assembly 68 and elevation turret base 34 of the present invention. More particularly, the lower portion 84 of the stop collar assembly is inserted into the top section 16 of the turret base. The stopper 76 follows a helical path when the stop collar assembly rotates that is radially removed from the axis 46. The track 60 receives the protruding portion of the stopper. The stopper and track each have a diameter of 5 mm, and their engagement height is about 0.5 mm, providing a total surface area of about 4 square millimeters. The relatively thick stopper has a relatively large contact surface area with the track's stop surface 66, which makes it less likely that the stopper will shear with extended use as it repeatedly and abruptly contacts the stop surface. Furthermore, because the stopper and stop surface are made of steel, they are substantially stronger and likely to be longer lasting than if they were made of aluminum or brass.

The stopper must be permitted to move smoothly within the track until the stopper reaches the track's stop surface. To accomplish this objective, the amount the stopper protrudes from the stopper bore 92 is related to the thread pitch of the threads 94 on the bottom of the turret screw. Specifically, the amount the stopper protrudes from the stopper bore is preferably three quarters of one thread pitch of the threads on the bottom of the turret screw, and the amount must be slightly less than one thread pitch. With this protrusion amount, the stopper can exit the track by passing over the opposite end of the track from the stop surface in less than a full rotation of the turret screw when rotated in a counterclockwise direction after the stopper has been stopped by the stop surface, while still providing a substantial depth of engagement. Otherwise, the turret would not be able to travel up more than somewhat less than one revolution. This would occur because the stopper would hit the opposite end of the track from the stop surface instead of clearing it to permit further counterclockwise rotation.

Furthermore, the track's depth should never be less than the protrusion amount of the stopper to ensure the stopper does not contact the bottom of the track. Any contact between the stopper and the bottom of the track could result in the transfer of undesirable force into the turret screw's threads 94. The transferred force could damage the threads because of the threads' extremely high precision.

The clicker 78 protrudes from the clicker channel 90 in the outer perimeter 80 of the lower portion. A spring 88 outwardly biases a brass piston 86 to which the clicker is attached such that the clicker 78 is biased to engage with the toothed surface 64 on the interior perimeter 62 of the turret base. When the stop collar assembly 68 rotates as the turret screw is rotated when changing elevation settings, the clicker travels over the toothed surface, thereby providing a rotational, resistant force and making a characteristic clicking sound.

The stop collar sleeve bore 74 closely and rotatably receives the stop collar sleeve 72. The stop collar sleeve bore has an upper reduced diameter portion 138 that provides a shoulder for positive axial location of the stop collar assembly against the top end 140 of the stop collar sleeve 72. The stop collar sleeve and stop collar sleeve bore surfaces are smooth to facilitate rotation of the stop collar assembly around the stop collar sleeve about the elevation turret rotation axis 46.

Figure 6:
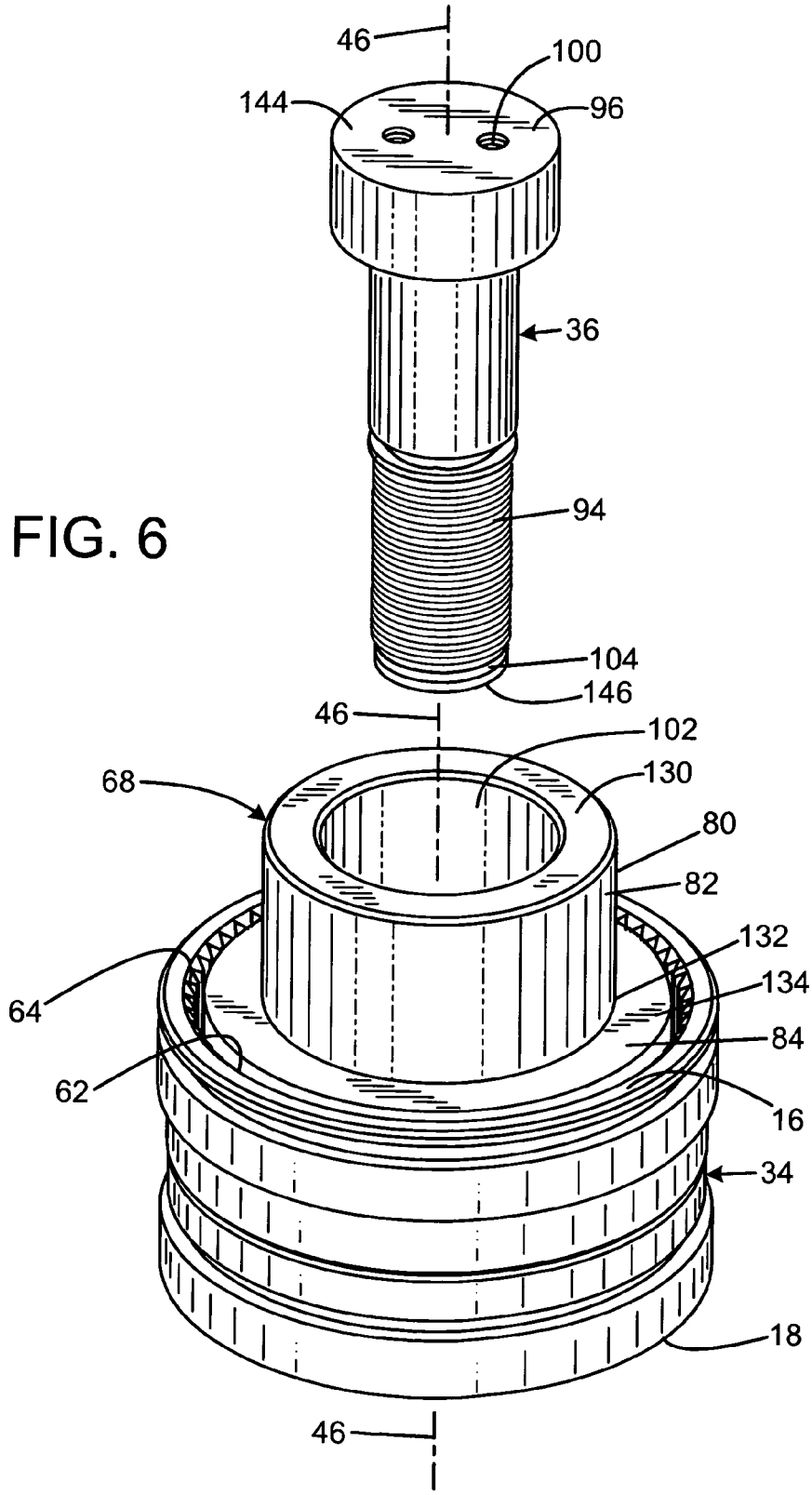
FIG. 6 is a top perspective exploded view of the turret screw, stop collar assembly, and elevation turret base of the present invention.

FIG. 6 illustrates the improved turret screw 36, stop collar assembly 68, and elevation turret base 34 of the present invention. More particularly, the lower portion 84 of the stop collar assembly is shown inserted into the top 16 of the turret base. The bottom 146 of the turret screw is inserted through the upper opening 102 in the top of the upper portion 82 of the stop collar assembly. The bottom of the brass turret screw terminates in a steel disc that presses against the upper surface of the movable optical element 126 and adjusts the optical axis 44 based on the number of clicks that have been dialed in on the elevation turret 12.

The threads 94 on the lower exterior portion of the turret screw threadedly engage with the threads of the turret screw bore 22 in the bottom of the turret base. The pitch of the threads depends on the focal length of the scope, what adjustment units are being used, and how much travel per turn is being used in the design of the elevation turret 12. For example, a scope 10 can be made in a Minute of Angle (MOA) version and a Milliradian (mrad) version. A MOA version using an objective focal length of 151.5 mm and 15 MOA of travel per turn would use a 0.661 mm thread pitch. The mrad version using a 151.5 mm focal length and 5 mrads per turn would use a 0.785 mm thread pitch.

A C-ring groove 104 on the bottom of the turret screw receives a C-ring 118. The C-ring 118 limits rotation of the screw beyond a maximum limit, preventing upward adjustment of the turret screw sufficient to detach its threads 94 from the turret screw bore 22.

The head 96 on the top 144 of the turret screw is received by the upper opening 102. The head 96 has two threaded fastener holes 100 that receive socket screws 110 on the inner turret cap.

Figure 7:
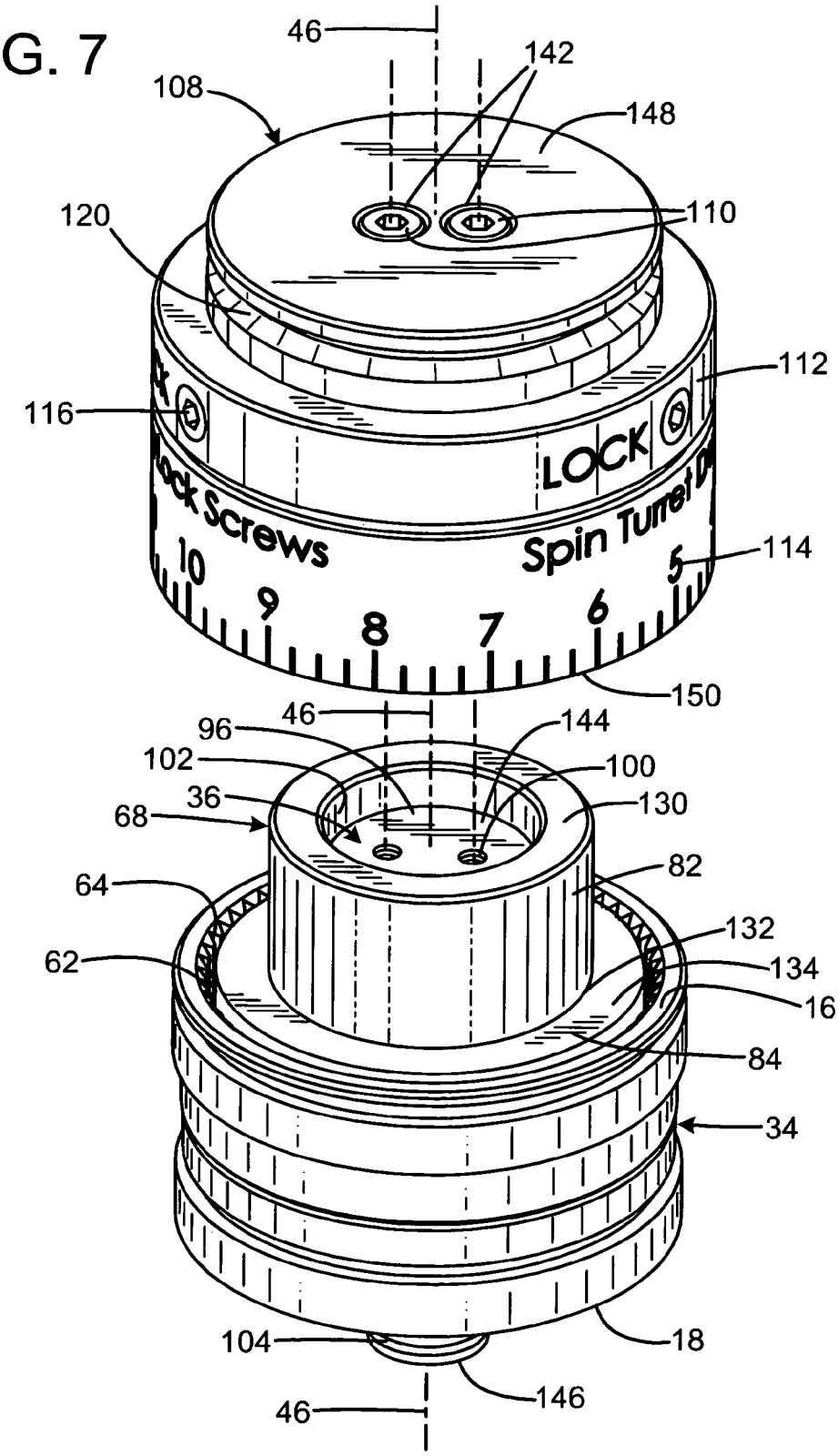
FIG. 7 is a top perspective exploded view of the inner turret cap, turret screw, stop collar assembly, and elevation turret base of the present invention.

FIG. 7 illustrates the improved inner turret cap 108, turret screw 36, stop collar assembly 68, and elevation turret base 34 of the present invention. More particularly, the top 148 of the aluminum inner turret cap is bored with two chamfered holes 142 to receive two socket screws 110. The socket screws are used to connect the inner turret cap to the head 96 of the turret screw using the fastener holes 100 so that the inner turret cap becomes effectively an integral part of the turret screw.

The exterior perimeter 112 of the top of the inner turret cap defines a set screw notch 120. The exterior perimeter 112 of the inner turret cap also has threaded bores receiving set screws 116 and displays indicia 114 at the bottom 150. The three steel set screws 116 secure the inner turret cap to the upper portion 82 of the stop collar assembly.

The indicia 114 are positioned around the exterior perimeter 112 and correspond to clicks of the elevation turret 12. Indicia typically include tick marks, each corresponding to a click, and larger tick marks at selected intervals, as well as numerals indicating angle of adjustment or distance for bullet drop compensation. The indicia 114 are used only for sighting-in purposes so the user can keep track of how much adjustment he or she has made. After sight-in, any of the indicia on the inner turret cap could face back towards the user, and these indicia are hidden in normal use by the outer turret cap 106.

Figure 8:
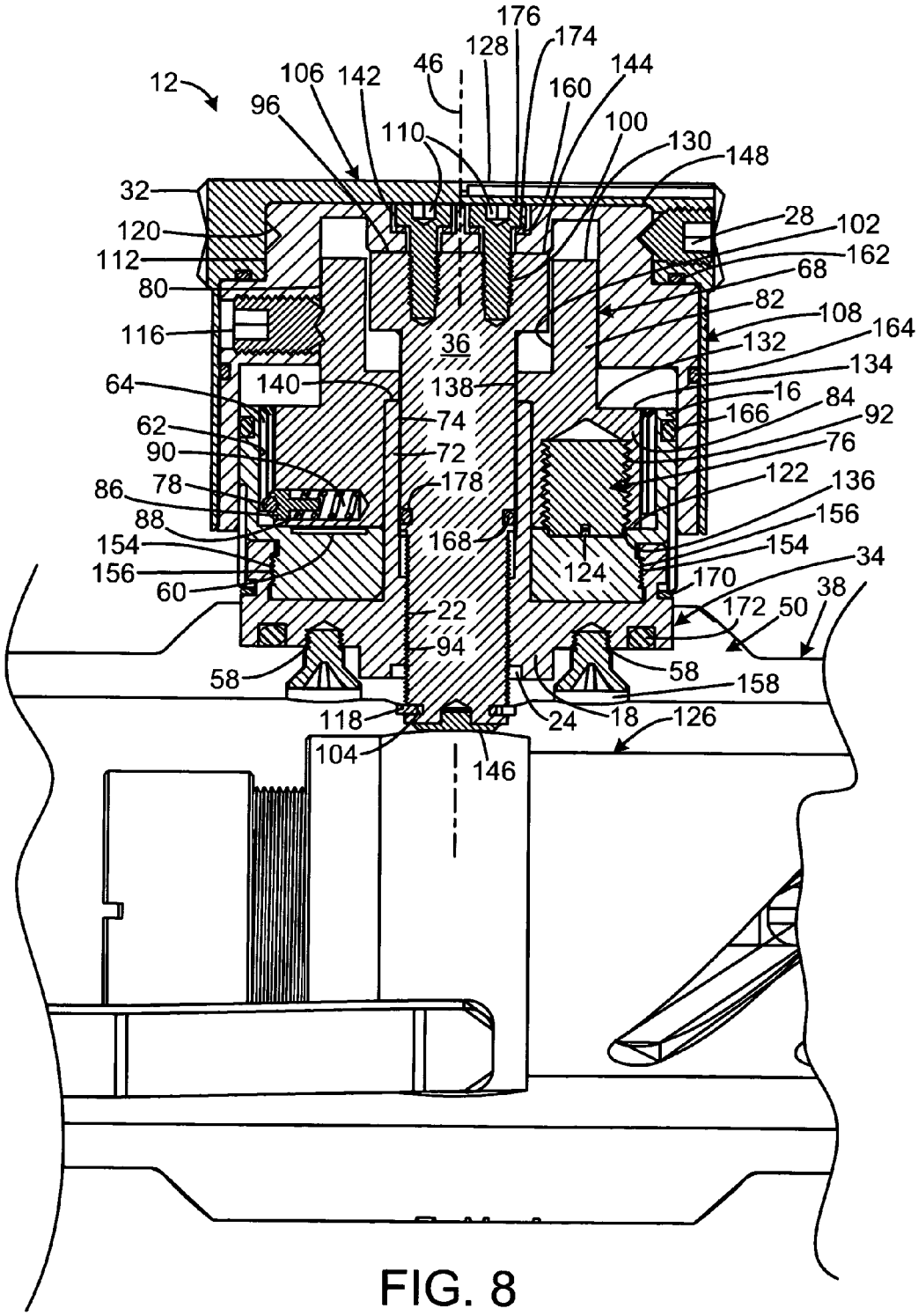
FIG. 8 is a side sectional view of the outer turret, inner turret cap, turret screw, stop collar assembly, elevation turret base, turret housing, and movable optical element of the present invention.

FIG. 8 illustrates the improved outer turret cap 106, inner turret cap 108, turret screw 36, stop collar assembly 68, elevation turret base 34, turret housing 50, and movable optical element 126 of the present invention assembled onto the turret housing 50. More particularly, the set screw notch 120 on the inner turret cap is adapted such that it may be securely engaged by steel set screws 28 on the outer turret cap 106 so that rotating the outer turret cap also causes the inner turret cap to rotate. The inner turret cap is secured to the upper portion 82 of the stop collar assembly by set screws 116 so that rotating the inner turret cap also causes the stop collar assembly and turret screw to rotate, thereby adjusting the elevation of the movable optical element.

The set screws 116 on the inner turret cap use a cup point. The cup point on the set screws enables them to dig into the outer perimeter 80 of the upper portion 82 of the stop collar assembly 68 better than a v-point, flat point, or dog point screw. This ensures the set screws have no chance of slipping once they are tightened. The stop collar assembly 68 is thick and sufficiently durable that it will not fail for many years under the forces imparted by the cup point set screws 116. However, the stop collar assembly is made of brass so that it is soft enough to permit the cup point screws to bite into it. A steel stop collar assembly would be too hard.

The upper portion 82 of the stop collar assembly has to be sufficiently tall such that the set screws 116 in the inner turret cap will be able to lock onto the upper portion of the stop collar at any point in the inner turret cap's vertical travel through its range of rotational adjustment. Therefore, the height of the upper portion is based on the amount of total elevation travel designed into the scope, as well as the scope's focal length.

Rotating the inner turret cap not only causes the turret screw to move upward or downward with respect to the turret base, but it also causes the clicker 78 to slide over the toothed surface 64, producing a click stop action. The socket screws 110 extending downward from the top 148 of the inner turret cap engage with the fastener holes 100 in the head 96 of the turret screw to impart rotational motion of the inner turret cap to the turret screw. Essentially, the inner cap 108 is fixed to the turret screw by screws 110, and the stop collar assembly 68 is adjustably fixed to the inner cap by the set screws 116.

O-rings 160, 162, 164, 166, 168, 170, and 172 seal the elevation turret 12 to protect its components from the elements. Each socket screw 110 has a groove 174 in the bottom of its head 176 that receives an O-ring 160. The O-ring 160 seals the bottom of the head with respect to the top of the inner turret cap. The O-ring 162 seals the bottom of the outer turret cap with respect to the top of the inner turret cap. The O-ring 164 seals the interior surface of the outer turret cap with respect to the outer perimeter of the inner turret cap. The O-ring 166 seals the interior perimeter of the inner turret cap with respect to the outer perimeter of the top of the turret base 34. The turret screw 36 has a circumferential groove 178 located just above its threaded portion 94 that receives an O-ring 168. The O-ring 168 seals the turret screw with respect to the interior perimeter of the stop collar sleeve 72. The O-ring 170 seals the exterior of the bottom of the turret base. The O-ring 172 seals the bottom of the turret base with respect to the top of the turret housing 50.

Figure 9:
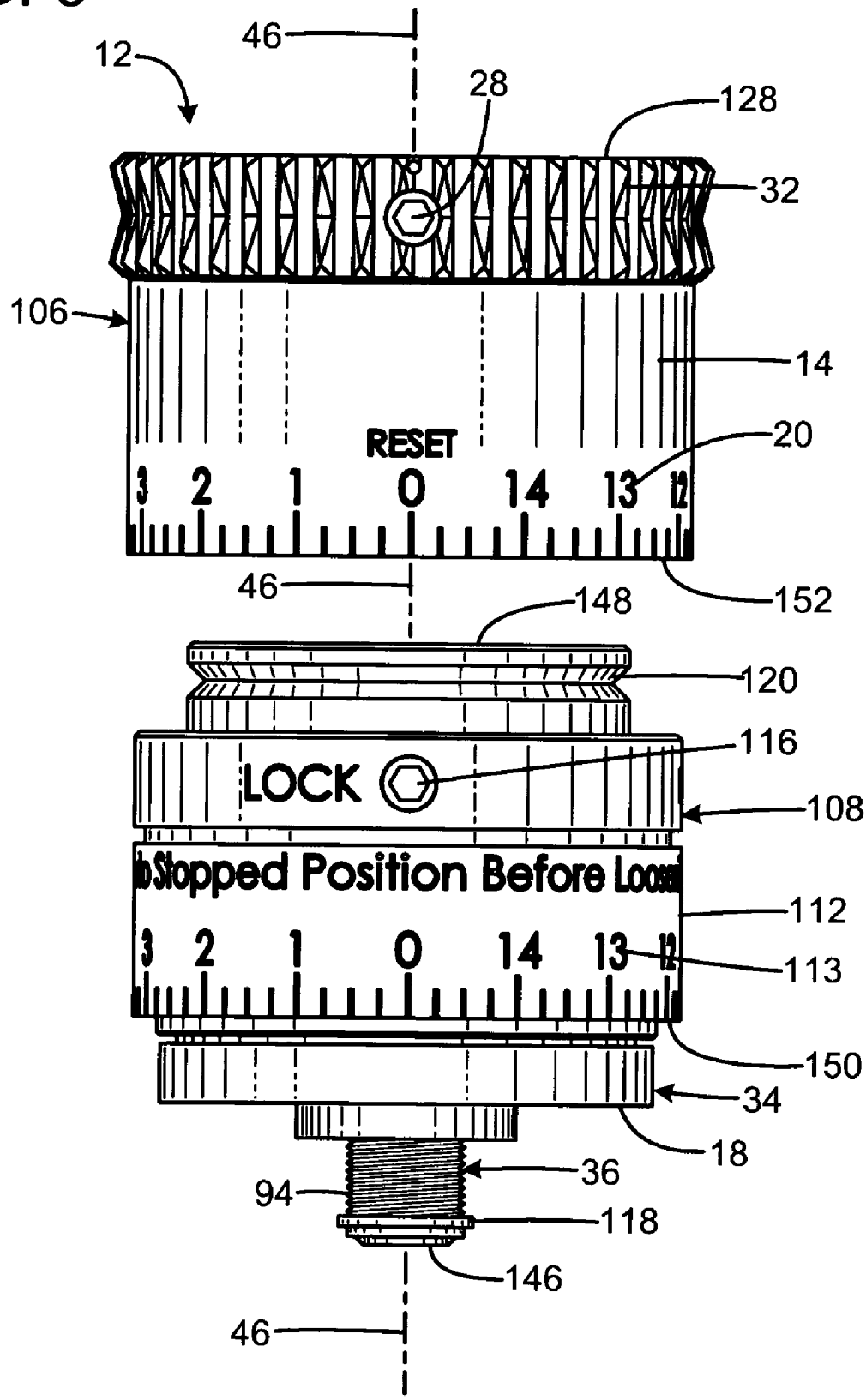
FIG. 9 is a top perspective exploded view of the outer turret, inner turret cap, turret screw, and elevation turret base of the present invention.

FIG. 9 illustrates the improved outer turret cap 106, inner turret cap 108, turret screw 36, and elevation turret base 34 of the present invention. More particularly, the aluminum outer turret cap is adjustably secured to the inner turret cap by set screws 28 located below its top 128 that engage the set screw notch 120 on the inner turret cap. This ensures that rotating the outer turret cap also causes the inner turret cap, turret screw, and stop collar assembly 68 to rotate, while permitting the outer turret cap to be calibrated to any position relative to the turret screw.

The top portion 32 of the perimeter 14 of the outer turret cap is knurled or otherwise textured or ruggedly contoured to facilitate gripping for rotation of the outer turret cap. Indicia 20 are positioned around the perimeter 14 at the bottom 152 and correspond to clicks of the elevation turret 12. Indicia typically include tick marks, each corresponding to a click, and larger tick marks at selected intervals, as well as numerals indicating angle of adjustment or distance for bullet drop compensation. After sight-in, the inner turret cap could end up with any of its indicia facing back towards the user. The indicia 20 on the outer turret cap enable the user to reset the position of the zero mark so that it faces back towards the user and aligns with a pointer mark fixed to the scope body as shown in FIG. 1.

When "0" on the outer turret cap is facing the user, the stopper is resting against the stop surface, which prevents any further downward adjustment of the turret screw. Zero on the outer turret cap is the distance the rifle scope is sighted in at when no clicks have been dialed in on the elevation turret and references the flight of the projectile. If the rifle scope is sighted in at 200 yards, it is said to have a 200 yard zero.

In use, the user sets the position of turret screw at which the adjustment stop in the elevation turret stops further downward adjustment using the following steps:

First, the user rotates the elevation turret to extend the turret screw downward until the elevation turret will not rotate any further because the stopper has reached the stop surface.

Second, if the outer turret cap is attached, the user loosens the three set screws on the outer turret cap and removes the outer turret cap from the inner turret cap.

Third, the user loosens the three set screws on the inner turret cap so that it is disengaged from the upper portion of the stop collar assembly. This permits the inner turret cap and turret screw to freely rotate without rotating the stop collar assembly. The stop collar assembly remains held in place with the stopper against the stop surface. This position is held stable by the clicker, which is engaged with the toothed surface of the turret base.

Fourth, the user adjusts the exposed length of the turret screw by rotating the inner turret cap and connected screw 36 until the scope's zero point for the rifle has been achieved. During sight-in, the inner turret cap continues to cover the stop collar assembly and the top of the turret base. As a result, the clicker, toothed surface, stopper, and track remain sealed by the O-rings, preventing their contamination by foreign material.

Fifth, the user tightens the three set screws in the inner turret cap to reengage the inner turret cap with the upper portion of the stop collar assembly. The sighted-in zero position is now set at the rotational stop limit of the turret.

Sixth, the user replaces the outer turret cap over the inner turret cap while aligning the "0" mark on the outer turret cap with whichever indicium on the inner turret cap is facing the user when the scope is at its zero point. The indicated zero now visually corresponds to the sighted in and "stop" zero.

Seventh, the user secures the outer turret cap to the inner turret cap by tightening the three set screws on the outer turret cap.

While a current embodiment of the rifle scope with adjustment stop has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle scope with adjustment stop comprising:

a scope body having a threaded bore;

a movable optical element defining an optical axis connected to the scope body;

a turret having a screw received in the threaded bore and operably connected to the optical element for adjusting the optical axis in response to rotation of the screw;

the turret having a stop element selectably engaged to the screw;

the body defining a stop surface positioned for engagement by the turret stop element to limit rotation of the screw, such that the relative position at which the stop element is secured to the screw defines a zero position of the screw and the movable optical element;

the turret having an indexing portion frictionally engaged with the stop element; and wherein the stop element is held stable against the stop surface by the indexing portion while the relative position at which the stop element is secured to the screw to define the zero position is adjusted.

2. The rifle scope of claim 1, further comprising:

wherein the indexing portion of the turret comprises a rotating element;

wherein the scope body comprises a fixed element;

wherein the stop surface is a raised portion of the scope body;

wherein rotation of the indexing portion in a first direction causes the stop element to move in the first direction;

wherein responsive to the stop element encountering the stop surface, further rotation of the indexing portion in the first direction is prevented.

3. The rifle scope of claim 2, further comprising:

wherein rotation of the indexing portion in a second direction causes the stop element to move in the second direction;

wherein the stop element does not encounter the stop surface when the rotating element is rotated in the second direction.

4. The rifle scope of claim 2, further comprising:

the screw having a threaded portion with a thread pitch; and wherein the stop element extends from the indexing portion in an amount that is less than one thread pitch of the threaded portion.

5. The rifle scope of claim 4, wherein the height of the stop surface is an amount that is less than one thread pitch of the threaded portion.

6. The rifle scope of claim 1, further comprising:

the turret having a first cap operably connected to the screw to adjust the position of the screw;

wherein the indexing portion is selectahly engaged to the first cap;

wherein the indexing portion of the turret has the stop element;

wherein the relative position at which the indexing portion is secured to the first cap defines the zero position of the screw and the movable optical element; and the indexing portion of the turret being covered by the first cap while the relative position at which the indexing portion is secured to the first cap to define a zero position of the screw and the movable optical element is established by the user.

7. The rifle scope of claim 6, further comprising:

wherein the indexing portion of the turret comprises a rotating element;

wherein the turret base comprises a fixed element;

wherein the stop surface is defined by a groove in the scope body;

wherein rotation of the indexing portion in a first direction causes the stop element to move in the first direction; and wherein responsive to the stop element encountering the stop surface, further rotation of the indexing portion in the first direction is prevented.

8. The rifle scope of claim 7, wherein the groove has a depth that is at least as great as an amount the stop element protrudes from the indexing portion.

9. The rifle scope of claim 7, further comprising:

wherein the indexing portion of the turret comprises a clicker, wherein the scope body comprises a toothed surface; and wherein the clicker engages with the toothed surface to produce a click stop indexing action.

10. The rifle scope of claim 9, further comprising indicia on the first cap, wherein each indicium corresponds to a click stop position.

11. The rifle scope of claim 7, further comprising:

wherein a portion of the stop element extending from the rotating element is cylindrical; and wherein the stop surface is C-shaped.

12. The rifle scope of claim 6, further comprising:

the screw having a threaded portion with a thread pitch; and wherein the adjustment stop extends from the indexing portion in an amount that is less than one thread pitch of the threaded portion.

13. The rifle scope of claim 6, further comprising:

a second cap operably connected to the first cap;

wherein the second cap covers indicia present on the first cap; and wherein a selected indicium on the second cap faces the user when the optical element is in the zero position.

* * * * *